US005113832A

United States Patent [19]

Heffron

[11] Patent Number: 5,113,832

[45] Date of Patent: May 19, 1992

[54] METHOD FOR AIR DENSITY COMPENSATION OF INTERNAL COMBUSTION ENGINES

[75] Inventor: Michael E. Heffron, Colorado Springs, Colo.

[73] Assignee: Pacer Industries, Inc., Pensacola, Fla.

[21] Appl. No.: 704,605

[22] Filed: May 23, 1991

[51] Int. Cl.[5] ..... F02M 51/00

[52] U.S. Cl. ..... 123/478; 123/435; 123/494

[58] Field of Search ..... 123/478, 435, 494, 486, 123/489

[56] References Cited

U.S. PATENT DOCUMENTS

| | | | |
|---|---|---|---|
| 4,305,287 | 12/1981 | Böhm et al. | 123/435 |
| 4,739,742 | 4/1988 | Staerzl | 123/494 |
| 4,766,869 | 8/1988 | Concini et al. | 123/478 |
| 4,815,435 | 3/1989 | Lefevre et al. | 123/489 |
| 4,884,546 | 12/1989 | Sogawa | 123/486 |
| 4,913,118 | 4/1990 | Watanabe | 123/435 |
| 4,947,820 | 8/1990 | Kushi | 123/478 |
| 4,962,739 | 10/1990 | Wataya | 123/435 |
| 4,987,773 | 1/1991 | Stiles et al. | 123/478 |

*Primary Examiner*—Raymond A. Nelli
*Attorney, Agent, or Firm*—Richard W. Hanes

[57] ABSTRACT

Apparatus and method for compensating fuel delivery to the cylinders of internal combustion engines for the barometric pressure; for the intake air temperature; and for the heat transferred from the internal engine surfaces to the intake air prior to the air being confined within the cylinder. In the apparatus, temperature sensors are placed to measure internal engine surfaces. The method and apparatus can be used with both a four-stroke or two-stroke engine. In a two-stroke engine, the sensor would be mounted on the crankcase; in a four-stroke, on the intake manifold.

11 Claims, 2 Drawing Sheets

METHOD FOR AIR DENSITY COMPENSATION OF INTERNAL COMBUSTION ENGINES

BACKGROUND OF THE INVENTION

The instant invention relates to the delivery of an air and fuel mixture to the cylinders of an internal combustion engine. In particular, the invention relates to an electronic fuel injection system which compensates for the heat transferred from internal engine surfaces to the intake air prior to the air being confined in each cylinder. An Electronic Fuel Injection system includes a storage tank, an intake manifold, an exhaust manifold, tubing, a muffler, a fuel gauge, a fuel filter and an air cleaner. In addition, the system has a fuel pump. The basic control component of the fuel injection system is an electronic control unit. Various operating conditions are monitored, the information is continuously fed to the control unit, and the control unit correspondingly determines the amount of fuel being fed into the air-fuel mix.

Engine operating conditions are monitored by a variety of sensors and switches which transmit electrical data to the preprogrammed (or programmable) analog (or digital) computer that is the control unit. In prior art fuel injection systems, the sensors used included a manifold absolute pressure sensor that monitors changes in the intake manifold pressure and thereby signals the control unit regarding variations in engine speed and load, and barometric pressure and altitude.

Additional prior art monitoring devices generally include (1) temperature sensors (for coolant and intake air—and, in some cases, for crankcase oil in a four-stroke engine), each of which is mounted somewhere within the area to be monitored; (2) a throttle-position switch (or sensor) which monitors throttle movement and its position as a function of the vehicle speed; (3) a speed sensor, the duty of which is to synchronize fuel injection with cylinder-valve operations; and (4) (in some systems) a fast-idle valve that operates to by-pass additional air into the manifold for cold starting and may be supplemented by an air solenoid valve (which responds to engine coolant temperature).

The resultant fuel amount desired is achieved utilizing the electronic control unit to actuate the fuel injectors—one for each cylinder—as is well known.

It is an object of the instant invention to provide a fuel-air mixture which is optimum for the particular engine used.

It is also a further object of the invention to provide a sensor for sensing the temperature of the engine casing or internal engine surfaces and for providing such temperature data to the electronic control unit.

It is a further object of the invention to provide a temperature sensor for the internal engine surfaces for either a two-stroke or a four-stroke engine.

SUMMARY OF THE INVENTION

The instant invention compensates for the engine heat that is transferred to the intake fuel-air mixture prior to the mixture being confined in the engine cylinder. A temperature sensor is placed to measure the heat of the internal engine surfaces. The output of the temperature sensor is fed to the electronic control unit and the compensation for the engine heat on the air-fuel mixture is empirically determined. Thus, the fuel requirements of the engine are determined utilizing the temperature sensor for the engine surfaces. As in prior art devices, barometric pressure data as well as air intake temperature data also influence the output of the electronic control unit.

The engine surface temperature sensor can be suitably located to effectively measure the temperature of internal engine surfaces for both a four-stroke or a two-stroke engine.

The invention further contemplates the method of controlling the air-fuel ratio fed to an internal combustion engine by monitoring the temperature of internal engine surface. The engine surface temperature data is then fed to the electronic control unit, along with other variable parameters to determine the optimum air-fuel mixture to be fed to the cylinders.

DETAILED DESCRIPTION OF THE PREFERRED EMBODIMENT

Figure 1:
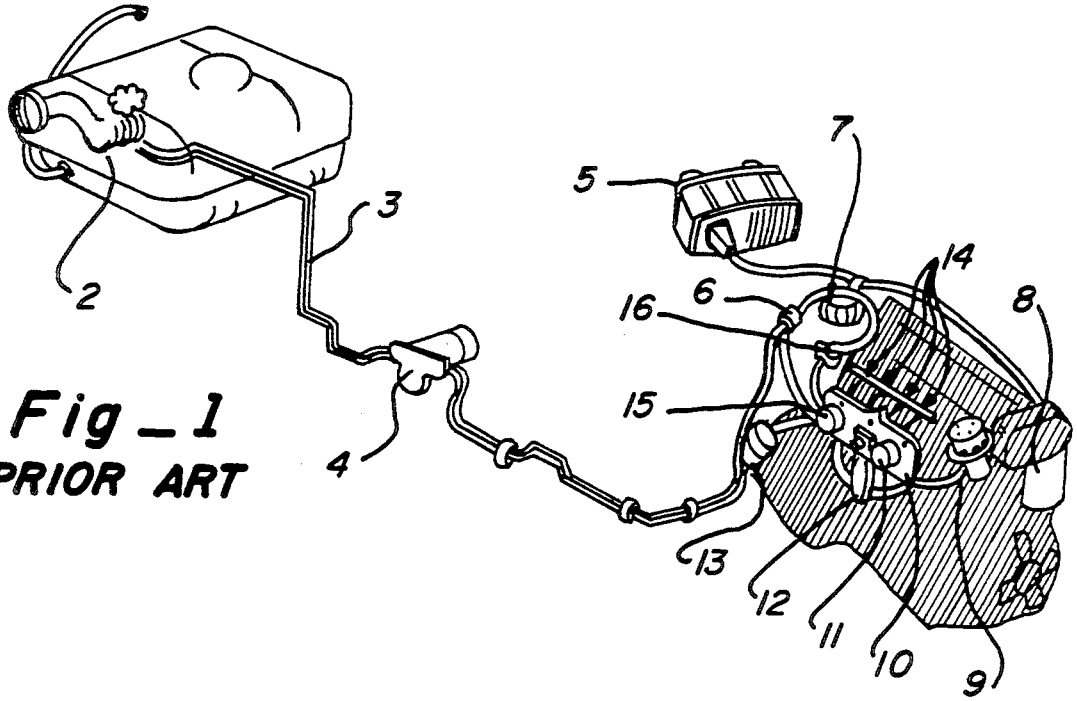
Fig 1 PRIOR ART
FIG. 1 is a schematic view of a typical prior art fuel injection system.
Figure 2:
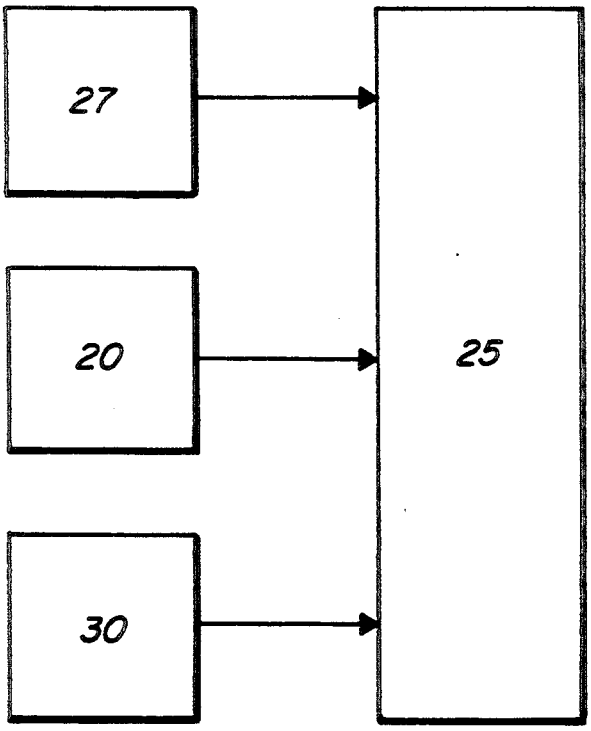
FIG. 2 is a block diagram showing the electronic control unit and the sensing output applied thereto.

FIG. 1 illustrates a well known prior art fuel injection system utilizing an electronic control unit. The fuel tank is shown at 2, and fuel pump 4 aids in pumping the fuel through fuel line 3. The electronic control unit for the fuel injection system is shown at 5 in FIG. 1 and in block diagram form at 25 in FIG. 2. Various operating conditions of the engine are monitored and the monitored information is continuously fed to the electronic control unit 5. The electronic control unit 5, based on the monitored conditions, continuously determines the amount of fuel being fed into the air-fuel mixture.

The manifold absolute pressure sensor 7 monitors changes in intake manifold pressure and thereby signals the control unit 5 regarding variations in engine speed and load, and barometric pressure and altitude. A coolant temperature sensor on switch 8 and an intake or ambient air temperature switch on sensor 10 is also provided. In the case of a four-stroke engine, a temperature sensor for the crankcase oil is frequently used. A throttle position switch or sensor 15 operates in response to the operator's movement of the gas pedal. A speed sensor 9 is also used to synchronize fuel injection with cylinder-valve operations. Some systems include a fast-idle valve 11 that operates to add additional air to the manifold for cold starts. Also, an additional air solenoid valve 16 which responds to engine coolant temperature can be provided.

The fuel injectors are shown at 14, and there is one injector for each cylinder. The fuel, under constant high pressure, passes through fuel filter 13 to each injector 14. Solenoids (not shown) operate each injector to be fully open or fully closed. Because the pressure in fuel line 3 is always the same, the length of time each injector is open is the sole factor in determining the amount of fuel injected. Thus, when the engine is operating, the electronic control unit 5 converts the information it receives into electrical impulses which determine when an injection solenoid is to open and how long it is to remain open.

The instant invention furthermore uses an internal engine surface temperature sensor (shown in block diagram form at 30 in FIG. 2) to provide the electronic control unit (shown in block form at 25) with further data. Such engine surface temperature data is used to provide a compensation factor along with the atmospheric or barometric pressure (shown in block form at 27) and ambient air temperature data (shown in block form at 20).

The generally accepted correction factor for compensating the fuel requirements of internal combustion engines for the atmospheric pressure (P) and the ambient air temperature (T) is as follows:

$$C_F = \frac{P_o\sqrt{T_r}}{P_r\sqrt{T_o}}$$

where subscripts r and o denote values at the reference and operating conditions, respectively. NOTE that this equation does not directly account for the heat transferred from the internal engine surfaces to the air until the air is confined within the cylinder. The relationship between the pressure (P), the temperature (T), and the volume (V) of a constant mass of any gas was determined in 1661 by Robert Boyle to be expressed by the following equation (a/k/a "Boyle's Law"):

$$\frac{P_rV_r}{T_r} = \frac{P_oV_o}{T_o}$$

Since the volume of the cylinder in an internal combustion engine is virtually constant, "Boyle's Law" reduces to the following equation for calculating the fuel requirements of internal combustion engines:

$$F_o = \frac{F_rP_oT_r}{P_rT_o}$$

where $F_o$ represents the fuel requirements for the conditions at which the engine is to be operated, $P_o$ represents the absolute (barometric) pressure at which the engine is to be operated, $T_o$ represents the absolute temperature of the air-fuel mixture at which the engine is to be operated, $F_r$ represents the fuel requirements originally determined for the engine (normally on a dynamometer), $P_r$ represents the absolute pressure for which the fuel requirements of the engine were originally determined, and $T_r$ represents the absolute temperature of the air-fuel mixture for which the fuel requirements of the engine were originally determined. Any absolute scale may be used for pressure and temperature measurements, provided that all pressures are measured on the same scale and all temperatures are measured on the same scale.

The instant invention uses the "Boyle's Law" relationship between the pressure, temperature, and the volume of the air, however, it also accounts for the engine heat transferred to the air by accurate sensor placement and by substituting the following equation for the T's in the preceding equation:

$$T_n = T_a + (T_e - T_a)e^k$$

where $T_n$ represents $T_r$ or $T_o$ of the previous equation, $T_a$ represents the intake or ambient air temperature, $T_e$ represents the engine temperature, and the mathematical exponential notation $e^k$ specifies the fraction of heat transferred from the engine to the air, where k is determined by the mechanical design of the engine (for many engines, k is nearly constant at −0.6931, yielding $e^k = 0.5$, however, k could become a fairly complex variable depending on the materials the engine is constructed from, the mechanical design of the engine, and the speed at which the engine is operated). Thus, the fuel requirements of the engine are expressed by the following equation:

$$F_o = \frac{F_rP_o[T_{ra} + (T_{re} - T_{ra})e^k]}{P_r[T_{oa} + (T_{oe} - T_{oa})e^k]}$$

Thus, utilizing the above equation, the electronic control unit 5 can utilize the temperature data sensed from the internal engine surfaces to effectively operate the solenoids for the fuel injection to achieve an optimum fuel-air mixture.

Figure 3:
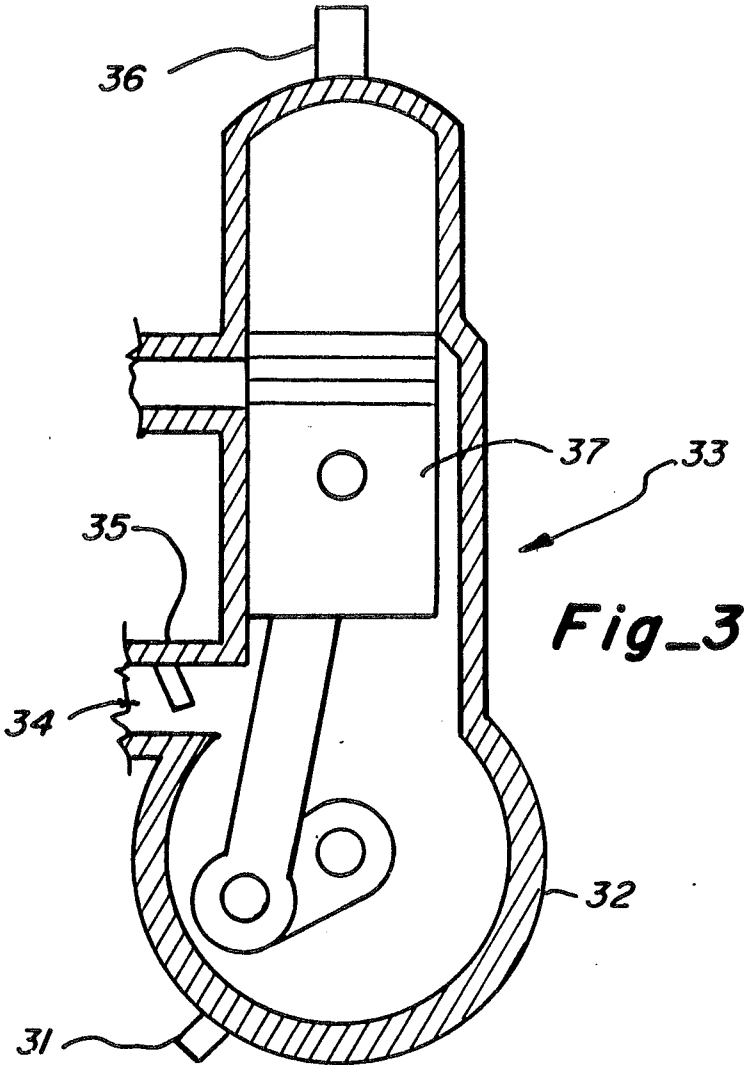
FIG. 3 is a cross-sectional view of the combustion cylinder of a two-stroke engine showing the location of the engine temperature sensor.

Accurate determination of the dynamic fuel requirements of an engine, using the preceding equation requires placement of the engine temperature sensor at a location that closely approximates the average temperature of the internal surface area of the engine that contacts the intake air as it travels into the cylinder. The best location for the engine temperature sensor 31 is normally the crankcase 32 of a two-stroke engine 33 as shown in FIG. 3. All the other parts are well known, although a few will be generally described for reference. The inlet is shown at 34, the reed spring inlet valve at 35, the spark plug at 36 and piston at 37.

Figure 4:
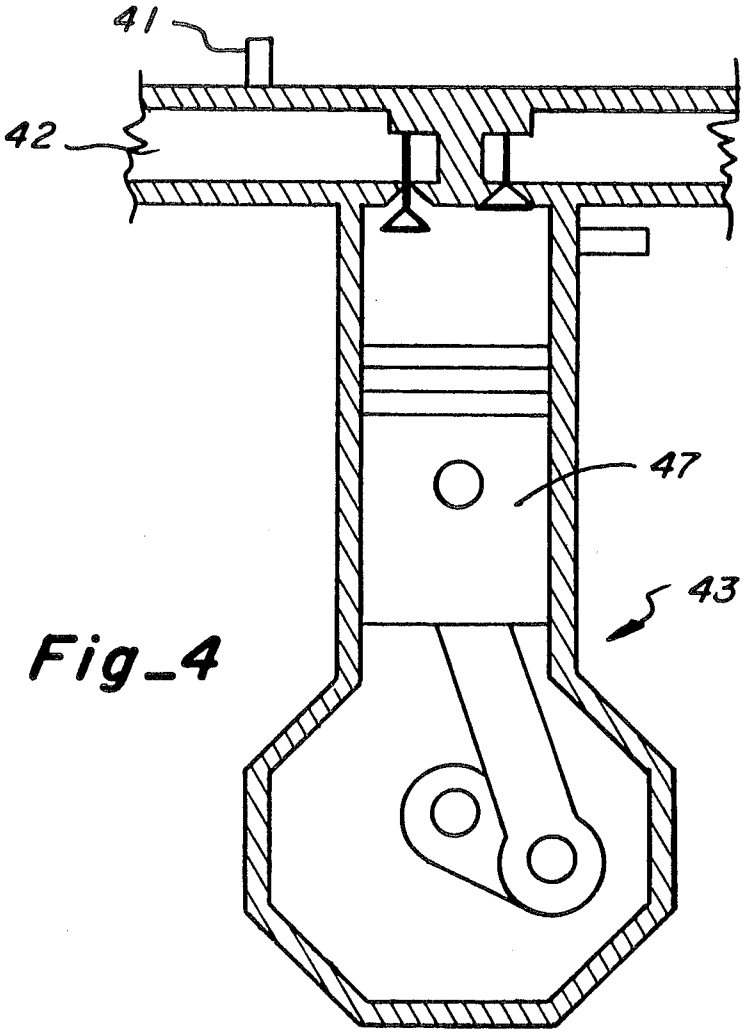
FIG. 4 is a cross-sectional view of the combustion cylinder of a four-stroke engine showing the location of the engine temperature sensor.

In the case of the four-stroke engine cylinder shown in FIG. 4, the preferred location of temperature sensor 41 is on the manifold intake 42. In this type of engine, the air-fuel mixture is heated primarily by the intake prior to the piston 47 pumping the mixture into the cylinder.

On complex engine designs, where there is no single location that closely approximates this average temperature, a weighted sum of multiple sensors may be used, e.g., 55% of the crankcase temperature plus 25% of the intake manifold temperature plus 20% of the water jacket temperature.

It is noted that the temperature sensor for the engine surfaces can be of any well known design and that the other parameters outlined above will also effect the output of the electronic control unit as is well known.

Accurate determination of the air density within the cylinder prior to combustion is critical to consistently achieve the stoichiometric air-fuel ratio that is essential for peak performance of all internal combustion engines in general, and is exceptionally critical for peak performance of two-stroke engines. However, the instant invention is also useful with a four-stroke engine as described.

I claim:

1. A method of controlling the air-fuel ration fed to at least one cylinder of an internal combustion engine, said engine having internal engine surfaces, said method comprising:

monitoring the temperature of said internal engine surfaces to produce an output indicative of the internal surface temperature of said engine;

said step of monitoring the temperature comprising placing a temperature sensor on at least one internal engine surface to monitor the temperature of such surface, feeding said output to an electronic control unit;

adjusting the mixture of air and fuel to be fed to the engine in response to the output of said electronic control unit.

2. The method of claim 1 further comprising the steps of:

measuring the barometric pressure and applying the barometric pressure output to the electronic control unit;

measuring the temperature of the ambient air for the fuel-air mixture and applying the ambient air temperature output to the electronic control unit.

3. The method of claim 1 wherein said engine is a four-stroke engine with an intake manifold and the step of placing a temperature sensor comprises placing a temperature sensor on said intake manifold.

4. The method of claim 1 wherein said engine is a two-stroke engine having a crankcase and the step of placing a temperature sensor comprises placing a temperature sensor on said crankcase.

5. The method of claim 2 wherein said step of adjusting the mixture of air and fuel further comprises applying the following fuel requirement equation to achieve the output of said electronic control unit:

$$F_o = \frac{F_r P_o[T_{ia} + (T_{re} - T_{ra})e^k]}{P_r[T_{oa} + (T_{oe} - T_{oa})e^k]}$$

where $F_o$ is the fuel requirements for the conditions at which the engine is to be operated, $P_o$ is the absolute barometric pressure at which the engine is to be operated, $T_{ra}$ is the absolute ambient temperature of the air-fuel mixture for which the fuel requirements of the engine were originally determined, $T_{re}$ is the absolute temperature of the internal engine surfaces for which the fuel requirements were originally determined, $P_r$ is the absolute pressure for which the fuel requirements of the engine were originally determined, $T_{oa}$ is the absolute ambient temperature of the air-fuel mixture at which the engine is to be operated, $T_{oe}$ is the absolute temperature of the internal engine surfaces at which the engine is to be operated, and the mathematical notation $e^k$ specifies the fraction of heat transferred from the engine to the air, where k is determined by the mechanical design of the engine.

6. A fuel system for an internal combustion engine utilizing fuel-air mixture for combustion, said engine having at least one cylinder, a temperature sensor located on at least one internal engine surface for sensing the temperature of such surface of said engine, an electronic control unit for controlling the amount of fuel in the air-fuel mixture for combustion, means for applying the output of said temperature sensor to the electronic control unit so that the optimum air-fuel mixture for the engine is applied to said cylinder.

7. The fuel system of claim 6 comprising means for sensing the barometric pressure and means for applying the output of said means for sensing the barometric pressure to said electronic control unit.

8. The fuel system of claim 7 comprising a sensor for sensing the ambient intake air temperature for the air to be used in the air-fuel mixture and means for applying the output of said ambient air temperature sensor to said electronic control unit.

9. The fuel system of claim 6 wherein said engine is a four-stroke engine having an intake manifold and said temperature sensor is located on said intake manifold.

10. The fuel system of claim 6 wherein said engine is a two-stroke engine having a crankcase and said temperature sensor is located on said crankcase.

11. The fuel system of claim 8 wherein said electronic control unit applies the following formula for controlling the amount of fuel in the air-fuel mixture:

$$F_o = \frac{F_r P_o[T_{ia} + (T_{re} - T_{ra})e^k]}{P_r[T_{oa} + (T_{oe} - T_{oa})e^k]}$$

where $F_o$ is the fuel requirements for the conditions at which the engine is to be operated, $P_o$ is the absolute barometric pressure at which the engine is to be operated, $T_{ra}$ is the absolute ambient temperature of the air-fuel mixture for which the fuel requirements of the engine were originally determined, $T_{re}$ is the absolute temperature of the internal engine surfaces for which the fuel requirements were originally determined, $P_r$ is the absolute pressure for which the fuel requirements of the engine were originally determined, $T_{oa}$ is the absolute ambient temperature of the air-fuel mixture at which the engine is to be operated, $T_{oe}$ is the absolute temperature of the internal engine surfaces at which the engine is to be operated, and the mathematical notation $e^k$ specifies the fraction of heat transferred from the engine to the air, where k is determined by the mechanical design of the engine.

* * * * *